US005247915A

United States Patent [19]

Sasada et al.

[11] Patent Number: 5,247,915

[45] Date of Patent: Sep. 28, 1993

[54] CYLINDER BLOCK STRUCTURE FOR AN INTERNAL COMBUSTION ENGINE

[75] Inventors: Takashi Sasada; Masashi Taniguchi; Tokio Ishino; Madoka Sakurai; Tetsuro Mutoh, all of Hiroshima, Japan

[73] Assignee: Mazda Motor Corporation, Hiroshima, Japan

[21] Appl. No.: 764,413

[22] Filed: Sep. 23, 1991

[30] Foreign Application Priority Data

| | | | |
|---|---|---|---|
| Dec. 29, 1990 | [JP] | Japan | 2-401764 |
| Dec. 29, 1990 | [JP] | Japan | 2-401765 |
| Dec. 29, 1990 | [JP] | Japan | 2-401766 |
| Dec. 29, 1990 | [JP] | Japan | 2-406059[U] |

[51] Int. Cl.[5] ..... F02F 7/00

[52] U.S. Cl. ..... 123/195 H; 123/195 C

[58] Field of Search ..... 123/195 R, 195 C, 195 H

[56] References Cited

U.S. PATENT DOCUMENTS

| | | | |
|---|---|---|---|
| 4,189,193 | 2/1980 | Schumacher | 123/195 H |
| 4,377,993 | 3/1983 | List | 123/195 H |
| 5,009,205 | 4/1991 | Abe et al. | 123/195 H |
| 5,014,659 | 5/1991 | Ohshima et al. | 123/195 H |

FOREIGN PATENT DOCUMENTS

| | | |
|---|---|---|
| 62-108612 | 12/1985 | Japan . |
| 63-61757 | 3/1988 | Japan . |

*Primary Examiner*—Noah P. Kamen

*Attorney, Agent, or Firm*—Fish & Richardson

[57] ABSTRACT

A skirt section of the cylinder block is shortened to the height of the rotational center of the crank shaft. To the bottom end of the skirt section is the lower cylinder block whose bottom end is coupled to the oil pan. The inner space of the lower cylinder block section is divided by plural partition walls extending transversely between the side walls of the lower cylinder block section. A bearing cap supporting the crank shaft has a boss section projecting transversely and a threaded hole is formed in the boss section. Further, the bottom end of the bearing cap has a threaded hole having an opening facing bottom. The lower cylinder block section is further provided at its side wall with a hole through which the side portion of the bearing cap is connected to the side wall of the lower cylinder block section. The bottom end of the bearing cap is connected to the side wall of the lower cylinder block section. This arrangement for the bearing caps improves rigidity for supporting the bearing caps, thereby permitting a decrease in the vibration of the engine.

12 Claims, 7 Drawing Sheets

CYLINDER BLOCK STRUCTURE FOR AN INTERNAL COMBUSTION ENGINE

BACKGROUND OF THE INVENTION

1. Field of the Invention

The present invention relates to a cylinder block structure for an internal combustion engine and, more particularly, to a cylinder block structure for an internal combustion engine having a main body of a cylinder block with cylinder bores and a lower cylinder block section to be fixed to a bottom end of the main body of the cylinder block.

2. Description of Related Art

U.S. Pat. No. 4,831,978 discloses a general structure of a conventional cylinder block wherein a skirt section serving as a space for accommodating a crank shaft is so arranged as to extend to an outwardly downward extent at its lower portion and wherein an oil pan is mounted to a bottom end of the skirt section. More specifically, a rear end portion of the skirt section of the cylinder block is in such a shape that its outer side portion is extended more and more in an outwardly rearward fashion as it approaches its rear end, and a transmission is mounted to a rear end of the skirt section thereof.

Further, Japanese Patent Laid-open (kokai) Publication No. 61,757/1988 discloses a cylinder block having a plate member so interposed between the skirt section thereof and the oil pan as to suppress the skirt section thereof from contracting or expanding.

On the other hand, Japanese Patent Laid-open (kokai) Publication No. 108,612/1987 discloses a cylinder block wherein a side wall of the skirt section is bolted to a side portion of a bearing cap supporting a crank shaft in order to enhance rigidity for supporting the crank shaft. Further, this prior publication discloses a plurality of bearing caps whose bottom ends are connected to each other with a beam constituted by a separate member.

It is to be noted herein that the interposition of the plate member between the skirt sections, the fastening of the bearing cap to the skirt section, and the disposition of the beak for connecting the bearing caps to each other are intended to decrease the vibration of the internal combustion engine and, as a consequence, lead to a decrease in a "power plant bending phenomenon". The term "power plant bending phenomenon" and related terms are intended herein to mean a phenomenon wherein a power plant containing the internal combustion engine and the transmission is caused to bend and transform in a curved shape as the internal combustion engine vibrates. This so-called power plant bending phenomenon is known as inducing vibration of the vehicle body.

Recently, there is one of the growing demands for internal combustion engines for automotive vehicles that the total weight of the engine should be made lightweight. In order to meet such a demand, attempts have been made of the structure of a cylinder block in which the lengthwise dimension of the skirt section, as called "short skirt", is shortened and a lower cylinder block section of the cylinder block is coupled to the bottom end of the shortened shirt section while an oil pan is mounted to the bottom end of the lower cylinder block section. For such a cylinder block of a so-called short skirt type, for example, the main body of the cylinder block is made of cast iron and the lower cylinder block section is made of aluminium, thereby making the total weight of the cylinder block lightweight.

Further, for the cylinder block of a so-called short skirt type, the lower cylinder block section is considered as a member for supporting the transmission and, in this respect, attempts has so far been made exclusively in order to ensure rigidity for the power plant bending phenomenon.

SUMMARY OF THE INVENTION

Therefore, the object of the present invention is to provide the structure of the cylinder block of a so-called short skirt type for an internal combustion engine, having a lower cylinder block section, so adapted as to reduce the vibration of the internal combustion engine.

In order to achieve the aforesaid object, the present invention provides a cylinder block structure for an internal combustion engine having a crank chamber comprising a skirt section of a main body of a cylinder block with a cylinder bore formed therein and a lower cylinder block section coupled to a bottom end of the skirt section thereof, wherein a crank shaft is disposed in the crank chamber; comprising:

a plurality of partition walls dividing transversely an inner space of the lower cylinder block into a plurality of sections, each of the partition walls extending transversely between a left side wall and a right side wall of the lower cylinder block section;

a plurality of bearing caps for supporting the crank shaft disposed in such a manner that at least a portion of the bearing caps is connected at a bottom end thereof to at least a portion of the partition walls: and at least a portion of the plurality of the bearing caps is connected at its side portion to a side wall of the lower cylinder block section.

With the aforesaid arrangement, the present invention improves rigidity for supporting the bearing cap by the aid of the lower cylinder block section and as a consequence enables a decrease in the vibration of the internal combustion engine because the bottom end or the side portion of the bearing cap is connected to the lower cylinder block section.

In a preferred aspect of the present invention, the side portion or portions of a portion of the plural bearing caps is or are connected to the side wall of the lower cylinder block section and the bottom end thereof is connected to the partition wall. In this embodiment, the bearing caps are prevented from cracking because the side portions and the bottom end of the bearing cap is connected to and supported by the lower cylinder block section composed of an integral member.

Other objects, features and advantages of the present invention will become apparent during the course of the description of the preferred embodiments, which follows, with reference to the accompanying drawings.

DESCRIPTIONS OF THE PREFERRED EMBODIMENTS

The present invention will be described more in detail with reference to the accompanying drawings.

Figure 1:
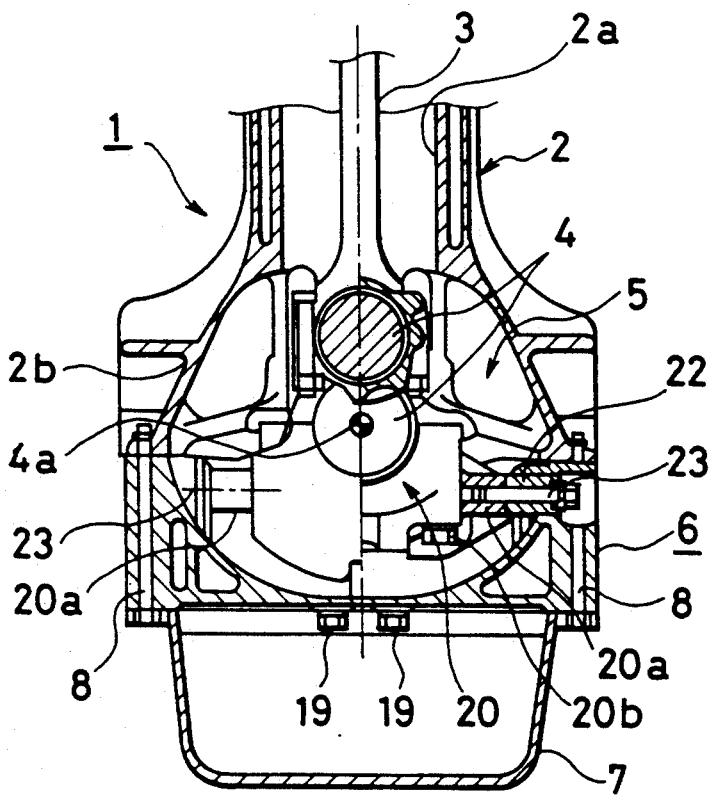
FIG. 1 is a longitudinally sectional view showing a lower half of the main body of an internal combustion engine.

As shown in FIG. 1, reference numeral 1 denotes the main body of an internal combustion engine having four cylinders of a 4-cycle reciprocating type. A cylinder block 2 of the main engine body 1 has a bore 2*a* into which a piston (not shown) is slidably inserted. The reciprocating movement of the piston is transmitted through a rod 3 to a crank shaft 4, thereby converting the reciprocating movement thereof into a rotary movement.

The cylinder block 2 is composed of cast iron and an inner surface of an inner wall of its skirt section 2*b* forming a crank chamber 5 is so designed as to extend from its top in an outwardly downward direction until the height of a bottom end of the skirt section 2*b* is located horizontally in the imaginary straight line passing through an axis 4*a* of rotation of the crank shaft 4, i.e. the bottom end of the skirt section 2*b* is substantially as high as the axis 4*a* of rotation of the crank shaft 4. To the bottom end of the skirt section 2*b* is mounted a lower cylinder block section 6 which in turn is associated with the skirt section 2*b* to form a substantial portion of the crank chamber 5. To a bottom end of the lower cylinder block section 6 is fixed an oil pan 7 by inserting bolts 8 through the entire depth of the side wall portion of the lower cylinder block section 6 from the side of the oil pan 7 and bolting the oil pan 7 and the lower cylinder block section 6 by securing a top side end portion of the lower cylinder block section 6 to a lower end flange of the cylinder block 2 with the bolts 8.

Description will now be made of the lower cylinder block section 6 with reference to FIGS. 2 et seq.

In this embodiment, the lower cylinder block section 6 is composed of aluminium in order to make its total weight lightweight. A rear end portion 6*a* of the lower cylinder block section 6 is so disposed as to extend gradually in an outwardly rearward direction as an outer side portion thereof approaches it rear end. To a rear end surface 6*a* of the lower cylinder block section 6 is mounted a transmission (not shown). The rear end surface 6*b* of the lower cylinder block section 6 will be described hereinafter.

Figure 3:
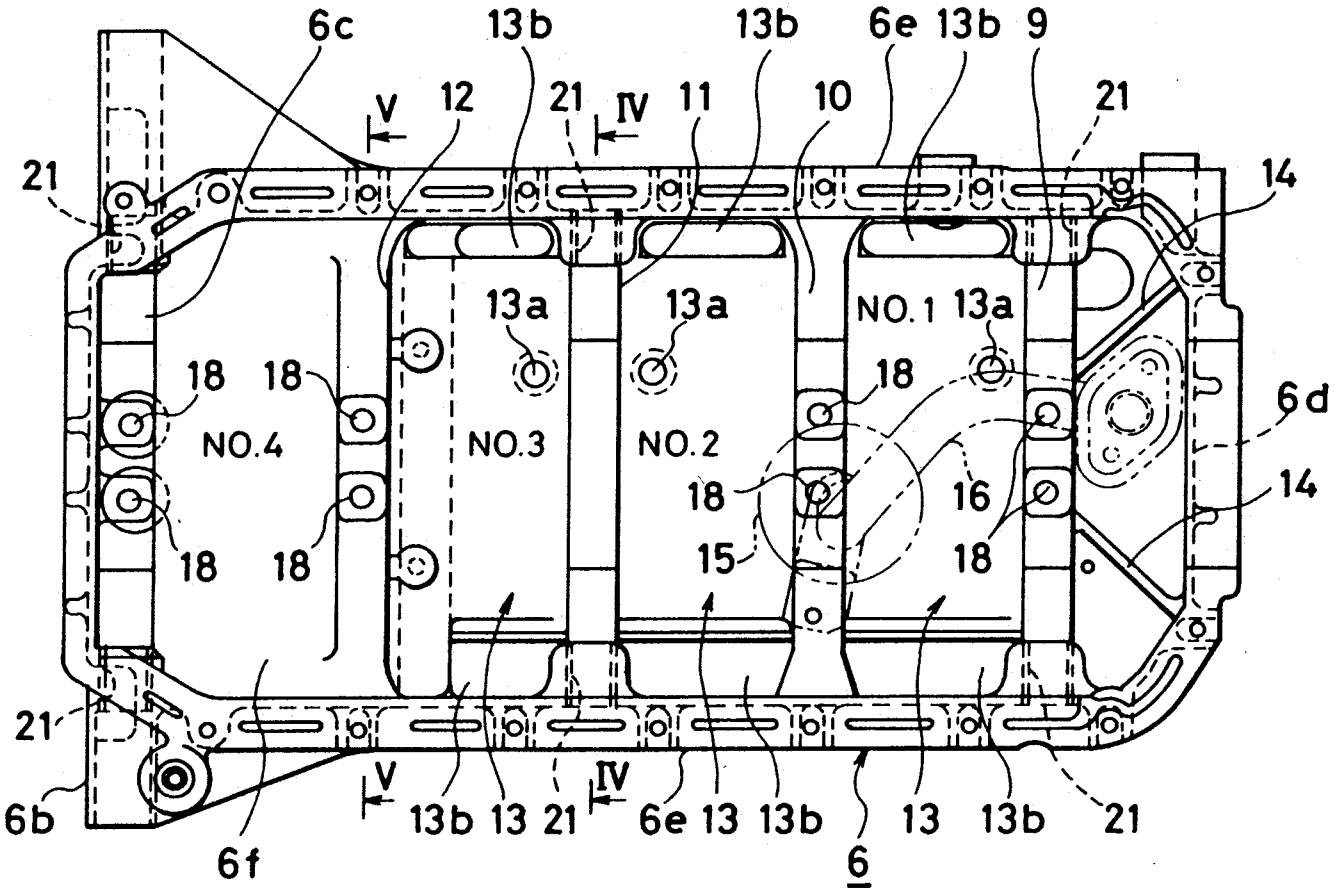
FIG. 3 is a plan view showing the lower cylinder block section when looked from top.

As shown specifically in FIG. 3, an inner space of the lower cylinder block section 6 is divided into four crank spaces Nos. 1 to 4, inclusive, for the respective cylinders by four partition walls 9 to 12, respectively, which are transversely disposed in a longitudinally spaced arrangement from its front side to its rear side (from the right side to the left side in FIG. 3). More specifically, a first crank space No. 1 for the first cylinder is formed by and defined between the first partition wall 9 and the second partition wall 10, a second crank space No. 2 for the second cylinder is formed by and defined between the second partition wall 10 and the third partition wall 11, a third crank space No. 3 for the third cylinder is formed by and defined between the third partition wall 11 and the fourth partition wall 12, and a fourth crank space No. 4 for the fourth cylinder is formed by and defined between the fourth partition wall 12 and an inner wall surface of a rear wall 6*c* of the lower cylinder block section 6. Each of the partition walls is connected to the adjacent partition wall through a plate section 13 interposed between them. In other words, for example, the first partition wall 9 and the adjacent second partition wall 10 interpose the plate section 13 to thereby connect the first partition wall 9 to the second partition wall 10, and the second partition wall 10 interposes the corresponding plate section 13 in association with the third partition wall 11. Likewise, the third partition wall 11 is in turn connected to the fourth partition wall 12 through the corresponding plate section 13. Further, the first partition wall 9 is connected through a rib 14 to an inner wall surface of a front end wall 6*d* of the lower cylinder block section 6, while the fourth partition wall 12 is connected to the inner wall surface of the rear wall 6*c* of the lower cylinder block section 6 through a bottom plate section 6*f* thereof. This arrangement of the partition walls suppresses them from contracting or expanding.

Each of the plate sections 13 interposed between the respective partition walls is provided at its both side portions with an oil return hole 13*a*, as shown in FIG. 3, which in turn is communicated to the oil pan 7, thereby allowing oil present within the respective crank spaces Nos. 1 to 3 to be returned to the oil pan 7. Further, each of the plate sections 13 has an opening section 13*b* so disposed at each of its side portions, i.e. at each of the respective side portions of the lower cylinder block section 6, as to communicate the respective crank space No. 1, 2 or 3 to the inner space of the oil pan 7, thereby returning the oil present in a mist state within the respective crank spaces Nos. 1 to 3 to the oil pan 7.

More specifically, as the corresponding piston for the first to third cylinders is pushed downwards, air within the respective crank spaces Nos. 1 to 3 is pushed out into the space of the oil pan 7, and the oil in the mist state within each of the crank spaces Nos. 1 to 3 is returned to the space of the oil pan 7, too. Oil stored in the oil pan 7 is pumped up by an oil pump (not shown), and the oil pumped up is led to each sliding element. In FIG. 3, reference numeral 15 stands for an oil strainer for cleaning oil and the resulting oil is led to the oil pump through an oil path 16.

Figure 6:
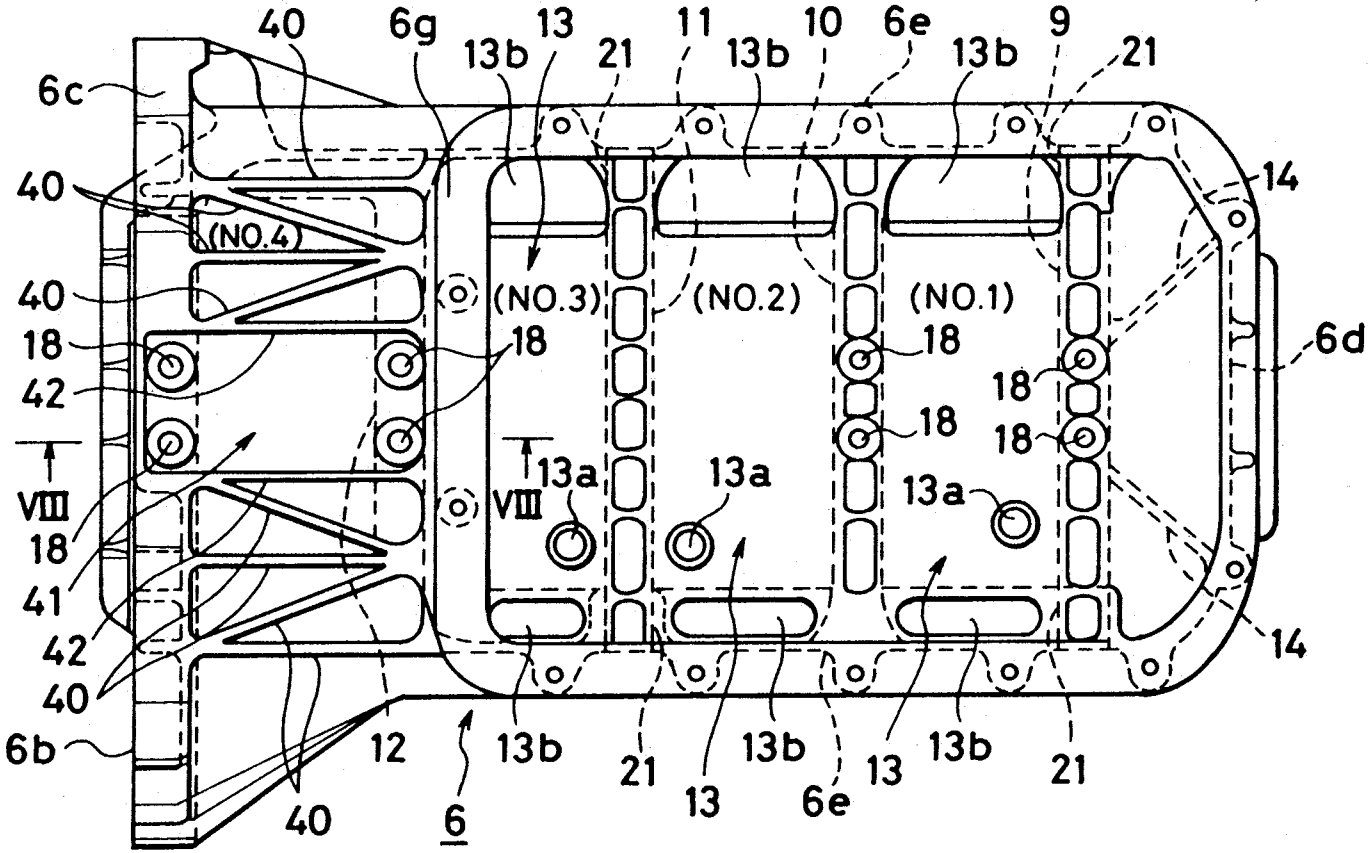
FIG. 6 is a bottom view showing the lower cylinder block section when looked from bottom.

The oil pan 7 is disposed in such a manner that its lengthwise dimension extends from the front end of the lower cylinder block section 6 to an intermediate position of the crank space No. 3 for the third cylinder, in order to mount the transmission to the rear end portion 6*a* of the lower cylinder block section 6. More specifically, as shown in FIG. 6, the lower cylinder block section 6 has a seat 6*g* for mounting the oil pan 7 and the rear end of the oil pan 7 is located in a position near yet ahead of the third partition wall 11. The rear end portion of the lower cylinder block section 6 is a portion where the outer surface of the lower cylinder block section 6 is so disposed as to extend in an outwardly rearward direction, as the outer surface thereof approaches its bottom side end, and furthermore, it is a portion where the fourth cylinder is located.

Each of the first, second and fourth partition walls 9, 10 and 12 as well as the rear end wall 6c of the lower cylinder block section 6 is provided at its transversely central portion with a pair of holes 18, so arranged in a transversely spaced relationship as to extend in an upward direction, through which bolts 19 are inserted over its entire depth. More specifically, the bolt 19 is inserted through the hole 18 from its bottom and a top portion of the bolt 19 is threaded with a threaded hole (not shown) formed so as to have an opening on the lower surface of a bearing cap 20. The bolt 19 makes the lower cylinder block section 6 integral with the bearing cap 20 in a position inside of a bolt 20b for coupling the bearing cap 20 with a bearing section (not section) of the main body of the cylinder block 2. As is well known, the bearing cap 20 is generally composed of cast iron and constitutes a lower half portion of the bearing section of the crank shaft 4.

Figure 4:
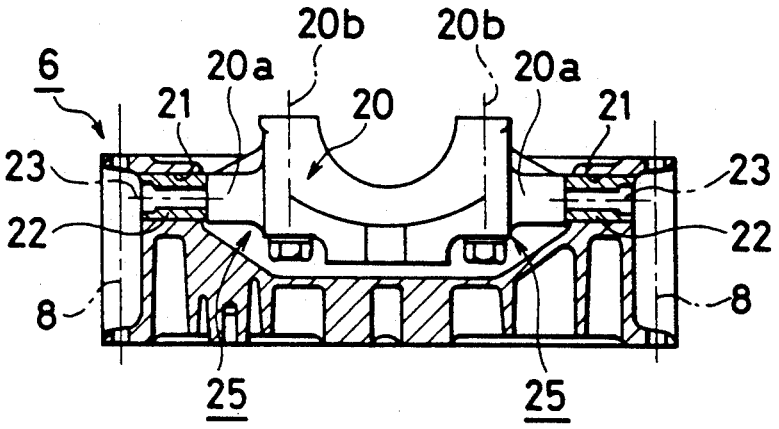
FIG. 4 is a sectional view taken along line IV—IV of FIG. 3.

Among the bearing caps 20, the bearing caps for the first partition wall 9, the third partition wall 11 and the rear end wall 6c of the lower cylinder block section 6 are constructed in such a manner that their side portions are disposed so as to be integral with the lower cylinder block section 6. More specifically, as shown in FIG. 4, each of the first and third partition walls 9 and 11 as well as the rear end wall 6c of the lower cylinder block section 6 has a hole 21 extending transversely, i.e. extending through its entire length from the left to the right in the drawing, and having an opening on a side wall 6e of the lower cylinder block section 6. A sliding bush 22 is inserted into the hole 21. On the other hand, each of the bearing caps 20 for the first and second partition walls 9 and 11 as well as the rear end wall 6c of the lower cylinder block section 6 is provided with a boss section 20a whose side portion projects towards the outside. The boss section 20a is provided with a threaded hole (not shown) which in turn is arranged to be threaded with a top portion of a bolt 23 inserted into the sliding bush 22, thereby making the side wall 6e of the lower cylinder block section 6 integral with the side portion of the bearing cap 20.

As described hereinabove, the bearing caps 20 for the first partition wall 9, the third partition wall 11 and the rear end wall 6c of the lower cylinder block section 6 have their side portions disposed integral with the lower cylinder block section 6. Further, the bearing caps 20 for the first partition wall 9 and the rear end wall 6c thereof are made integral with the lower cylinder block section 6 at their bottom portions. On the other hand, as shown in FIG. 5, the bearing caps 20 (20A) for the second and fourth partition walls 10 and 12 are provided with no boss section at their side portions and only their bottom portions are made integral with the lower cylinder block section 6.

With the arrangement as described hereinabove, the bearing caps 20 are connected to the lower cylinder block section 6 so that supporting rigidity of the bearing caps 20 can be improved without using a beam which is conventionally employed as a separate member. In particular, the side portions of the bearing cap 20 with the boss section 20a is connected to the lower cylinder block section 6 and the bearing cap 20 is pressed from its side by the lower cylinder block section 6, so that the bearing cap 20 is prevented from cracking. Furthermore, as the lower portions of the bearing caps 20 disposed at the first partition wall 9 and the rear end wall 6c of the lower cylinder block section 6 are further integral with the lower cylinder block section 6 and consequently they are pressed from bottom by the lower cylinder block section 6, the bearing caps 20 can be prevented from cracking more effectively.

As the sliding bush 22 is disposed so as to fix the side portion of the corresponding bearing cap 20, the sliding bush 22 can absorb a dimensional difference of the bearing cap 20, thereby improving operation performance in assembling internal combustion engines for automotive vehicles.

Figure 5:
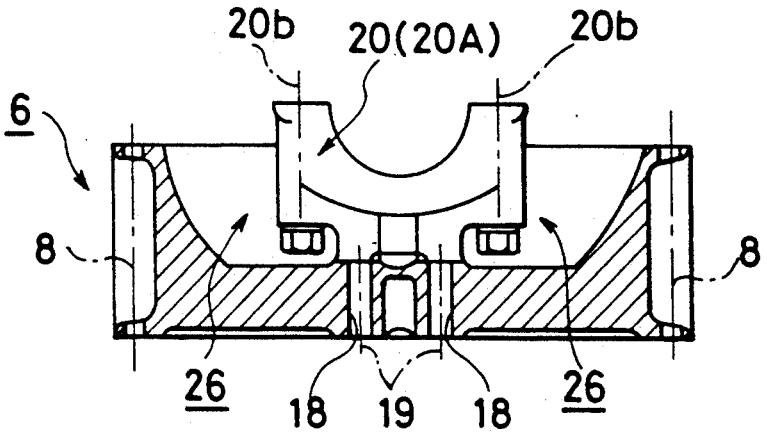
FIG. 5 is a sectional view taken along line V—V of FIG. 3.

A first space 25 formed by and defined between the bearing cap 20 with the boss section 20a and the corresponding partition wall, e.g. first partition wall 9, as shown in FIG. 4, is set to be smaller than a second space 26 defined between the bearing cap 20A without the boss section and the corresponding partition wall, e.g. second partition wall 10, as shown in FIG. 5, due to the fact that the boss section 20a is disposed.

It is to be noted accordingly that the second partition wall 10 having the boss-free bearing cap 20A divides the crank space into the first crank space No. 1 for the first cylinder and the second crank space No. 2 for the second cylinder, so that the second space 26, i.e. the boss-free space, constitutes a connecting section that communicates the crank space No. 1 to the crank space No. 2. Likewise, the boss-free space 26 for the fourth partition wall 12 constitutes a connecting portion that communicates the third crank space No. 3 for the third cylinder to the fourth crank space No. 4 for the fourth cylinder. On the other hand, the first space 25 for the third partition wall 11 constitutes a connecting section communicating the second crank space No. 2 for the second cylinder with the third crank space No. 3 for the third cylinder. Hence, it is to be noted that the first space 25 communicating the second crank space No. 2 to the third crank space No. 3 is smaller in effective passage area than each of the second space 26 communicating the first crank space No. 1 to the second crank space No. 2 and the second space 26 communicating the third crank space No. 3 to the fourth crank space No. 4, due to the provision of the boss section 20a for the corresponding bearing cap 20.

For the internal combustion engine 1, sparks are produced in the order of cylinders, i.e. from the first cylinder through the third cylinder and the fourth cylinder to the second cylinder. Hence, the pistons for the first and fourth cylinders are moved in the same direction, while the pistons for the second and third cylinders are moved in the same direction yet opposite to the movement of the pistons for the first and fourth cylinders. More specifically, the piston for the first cylinder is moved in the direction opposite to the direction in which the piston for the second cylinder communicated to the first cylinder through the connecting section 26 having no boss section and having the larger effective passage area is moved. Likewise, the piston for the third cylinder is moved in the direction opposite to the direction in which the piston for the fourth cylinder communicated to the third cylinder through the connecting section 26 having no boss section and having the larger effective passage area is moved. On the other hand, the piston for the second cylinder is moved in the direction identical to the direction in which the third cylinder communicated to the second cylinder through the connecting section 25 having the boss section and having the smaller effective passage area is moved.

Hence, as the piston for the corresponding cylinder is moved downwards, for example, the air within the second crank space No. 2 is smoothly transferred by a portion of the air corresponding to one stroke of the piston to the first crank space No. 1 through the connecting section 26 having the larger effective passage area, thereby elevating the piston for the first cylinder. Likewise, the air within the third crank space No. 3 is smoothly transferred by a portion of the air corresponding to one stroke of the piston to the fourth crank space No. 4 through the connecting section 26, thereby elevating the piston for the fourth cylinder. On the other hand, as the piston for the cylinder is moved upwards, the air within the corresponding cylinder s smoothly transferred by a portion of the air corresponding to one stroke of the piston to the adjacent crank space through the connecting section 26, thereby lowering the piston for the adjacent cylinder. Accordingly, the pistons are allowed to be elevated or lowered smoothly without being suppressed by the air within the crank space, thereby decreasing a pumping loss associated with the suppression of air within the crank space from moving the piston.

In particular, as the fourth crank space No. 4 for the fourth cylinder is defined by the bottom plate section 6*f* of the lower cylinder block section 6 and is not communicated directly with the space within the oil pan 7, i.e. as no opening 13*b* communicated to the oil pan 7 is provided unlike the crank space No. 3 and so on, as described hereinabove, the fourth crank space No. is communicated with the third crank space No. 3 through the connecting section 26 having the larger effective passage area, thereby permitting a decrease in a pumping loss of the fourth cylinder.

Figure 7:
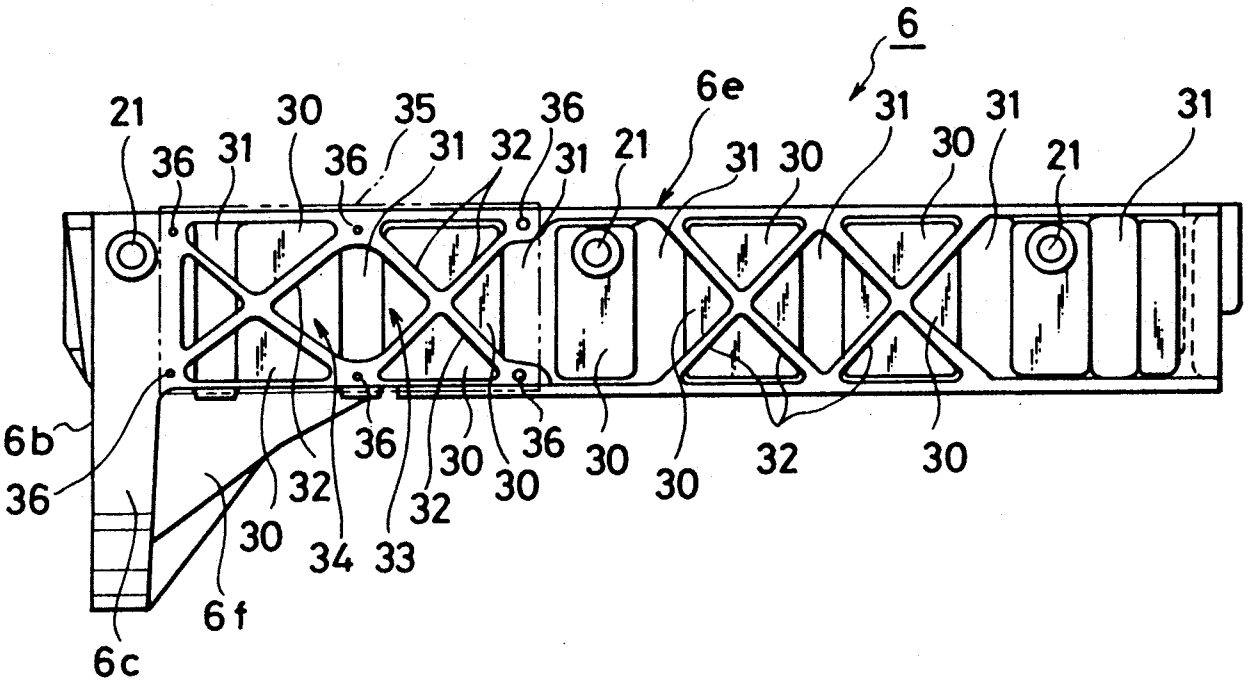
FIG. 7 is a side view showing the lower cylinder block section when looked from side.

As shown in FIG. 7, a side wall 6*e* of the lower cylinder block section 6 comprises a thin plate section 30, column sections 31 juxtaposed in a spaced arrangement, and a rib 32. The column section 31 has a hole through which the bolt 8 is inserted for fastening the lower cylinder block section 6 to the main body of the cylinder block 2. The rib 32 is disposed in a crosswise arrangement to enhance rigidity against a twist of the lower cylinder block section 6. A portion 33 of the side wall section of the third crank space No.3 defined and surrounded by the column section 31 and a crosswise section of the rib 32 confronting the column section 31 is provided with no thin plate. Likewise, a portion 34 of the side wall section of the fourth crank space No. 4 defined and surrounded by the column section 31 and a crosswise section of the rib 32 confronting the column section 31 is provided with no thin plate. In other words, the portions 33 and 34 of the side wall portion of the lower cylinder block section 6 are open towards the side thereof. The open side wall portions 33 and 34 are covered with, for example, a plate member 35 separate from the lower cylinder block section 6 in order to keep the connection between the open side wall portions 33 and 34. The plate member 35 is bolted to the side wall 6*e* of the lower cylinder block section 6 through holes 36 formed on the side wall 6*e* thereof, as shown in FIG. 7.

The aforesaid arrangement allows the third crank space No. 3 for the third cylinder to be communicated to the fourth crank space No. 4 for the fourth cylinder through the open side wall portions 33 and 34 as well as a passage formed on the side of the lower cylinder block section 6 and defined by the column section 31 and the plate member 35. For the fourth cylinder, this arrangement can further decrease a pumping loss, in association with the connecting section 26.

In other words, as the crank space No. 4 for the fourth cylinder has no directly connecting relationship with the oil pan 7 because the oil pan 7 is not extended up to the fourth cylinder, the air present within the crank space No. 4 cannot be removed through the oil pan 7 during the course of strokes of the fourth cylinder, thereby causing the piston to contract the air present in the crank space. However, in this embodiment, as the fourth cylinder is communicated to the third cylinder through a path formed outside the cylinder block in association with the plate member 35, the air present within the crank space No. 4 for the fourth cylinder can be removed towards the third cylinder in a smooth way during the course of strokes of the fourth cylinder.

The open side wall portions 33 and 34 as well as the plate member 35 may be mounted to one or both of the side walls 6*e* of the lower cylinder block section 6. The plate member 35 can also serves as a reinforcement member for the lower cylinder block section 6 in order to improve rigidity against bending of the lower cylinder block section 6. The function of the plate member 35 as the reinforcement member may be adjusted by changing its material or its plate thickness or by forming beads in the plate member.

Figure 8:
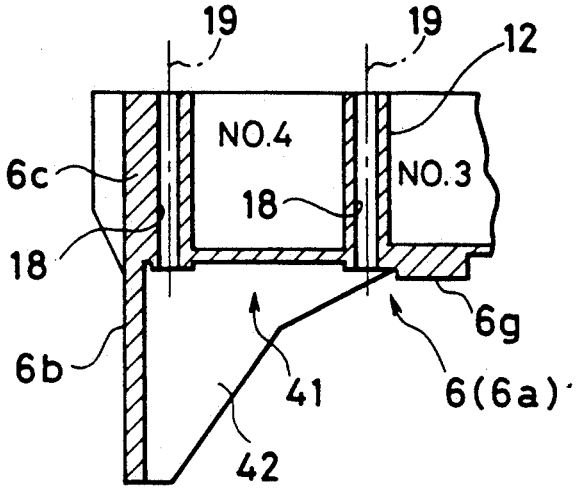
FIG. 8 is a sectional view taken along line VIII—VIII of FIG. 6.

Description will now be made of the rear end portion 6*a* of the lower cylinder block section 6 with reference to FIGS. 6 and 8.

As described hereinabove, the rear end portion 6*a* of the lower cylinder block section 6 is of such a shape that its outer side portion is expanded from the position of the fourth partition wall 12 in an outward direction as it approaches the rear end 6*b* of the lower cylinder block section 6. The outwardly expanded shape of the rear end portion 6*a* of the lower cylinder block section 6 can ensure a sufficient degree of rigidity against bending of the lower cylinder block section 6 with the transmission mounted thereto.

On the both side portions of the bottom of the rear end portion 6*a* of the lower cylinder block section 6 are disposed a plurality of ribs 40 connecting the seat 6*g* for mounting the oil pan 7 to the rear end wall 6*c* of the lower cylinder block section 6. At a middle portion interposed between the left and right ribs 40, there is disposed an inward concave portion 41 having an opening formed so as to face the bottom. The inward concave portion 41 is separated from the side portions with the ribs 40 formed thereon through a second rib 42 extending between the seat 6*g* for mounting the oil pan 7 and the rear end wall 6*c* of the lower cylinder block section 6. The inward concave portion 41 allows the holes 18 formed on the fourth partition wall 12 and the rear end wall 6*c* of the lower cylinder block section 6 to be equal in hole depth to the holes 18 formed on the partition wall 11 and so on, so that rigidity for supporting the bearing caps 20 disposed on the fourth partition wall 12 and the rear end wall 6*c* of the lower cylinder block section 6 can be enhanced.

Further, the lengthwise dimension of each of the holes formed for inserting the bolt 18 in the fourth partition wall 12 and the rear end wall 6*c* of the lower cylinder block section 6 is identical to that of the hole formed for inserting the bolt 18 in each of the other partition wall 11 and so on, thereby enhancing rigidity for supporting the bearing caps 20 disposed at the fourth partition wall 12 and the rear end wall 6*c* of the lower cylinder block section 6.

In other words, in instances where the lower portion of the bearing cap 20 is bolted without forming such an inward concave portion 41, a bolt 19 should be long enough to pass over the entire length of the downward expanded rear end portion 6a of the lower cylinder block section 6. On the contrary, the provision of the inward concave portion 41 makes the hole to be formed for inserting the bolt 19 through the side wall portion shorter in length, so that the lengthwise axis of the bolt 19 can be made shorter, thereby providing the bolt 19 with a sufficient degree of rigidity for supporting the bearing cap 20.

The aforesaid arrangement of the ribs 40 and the inward concave portion 41 in the rear end portion 6a of the lower cylinder block section 6 allows the rear end wall 6c of the lower cylinder block section 6 to be connected to the fourth partition wall 12 with high rigidity, thereby enhancing rigidity of the rear end wall 6c of the lower cylinder block section 6 that undergoes direct influence from a power plant and suppressing the power plant from bending or noises from occurring due to the bending of the power plant.

Figure 2:
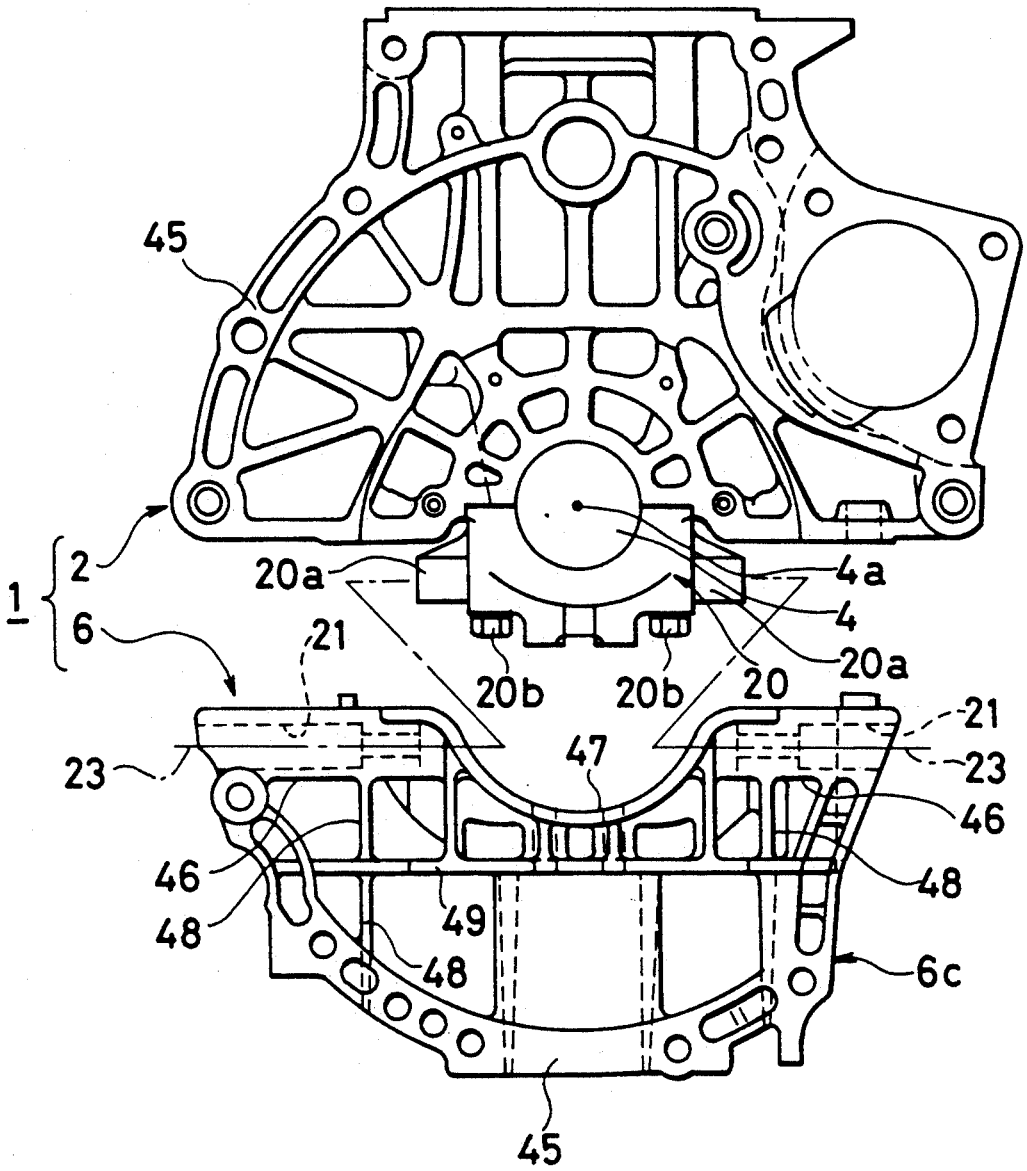
FIG. 2 is a rear view showing a cylinder block when looked from rear.

The rear end surface 6b of the lower cylinder block section 6 will now be described with reference to FIG. 2 showing the main body of the cylinder block 2 and the lower cylinder block section 6 when looked from rear. As shown in FIG. 2, the main body of the cylinder block 2 and the lower cylinder block section 6 are provided with a flange 45 to which the transmission is bolted, a flange 45 for mounting the transmission being so disposed as to project in a rearward direction.

As described hereinabove, the lower cylinder block section 6 is provided at its rear end wall 6c with the transversely extending hole 21 and the bolt 23 is inserted into the hole 21 through the sliding bush 22 to fix the bearing cap 20. A boss portion 46 of the transversely extending hole 21 is of a longitudinally sectionally cylindrical shape extending along the rear end wall 6c of the lower cylinder block section 6. The left and right boss sections 46 are connected to each other with a first rib 47 extending in a transverse direction.

The rear end wall 6c of the lower cylinder block section 6 is further provided with a second rib 48 and a third rib 49, each projecting in a rearward direction. More specifically, the first rib 48, i.e. a longitudinal rib, extends in a vertical direction and a top end thereof is connected to the boss section 46 while a bottom end thereof is connected to the flange 45 for mounting the transmission. On the other hand, the second rib 49, i.e. a transverse rib, is disposed so as to extend transversely in such a manner as intersecting the first (longitudinal) rib 48 and both of the left and right ends thereof are connected to the flange 45 for mounting the transmission.

Figure 9:
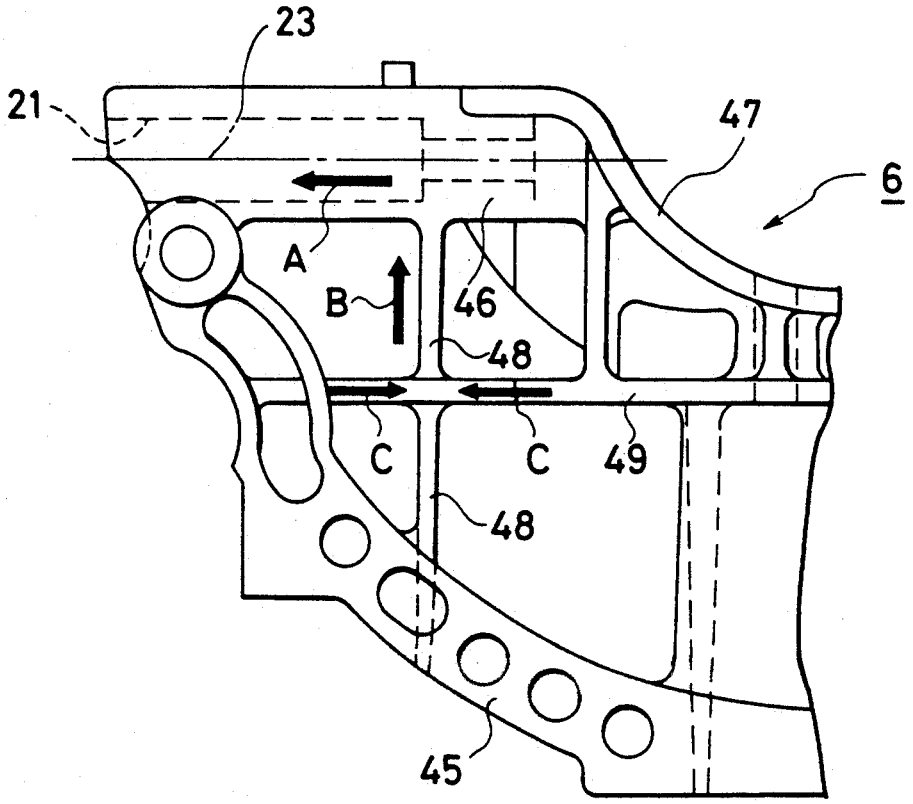
FIG. 9 is a partial view with an essential portion enlarged, showing a rear end of the lower cylinder block section.

In the aforesaid arrangement for the ribs, when the side portion of the bearing cap 20 are fixed to the rear end wall 6c of the lower cylinder block section 6 with the bolt 23, i.e. when the side portion (the boss section 20a) of the bearing cap 20 is fastened with the bolt 23 to the crank shaft 4 and the lower cylinder block section 6 incorporated into the main body of the cylinder block 2 in mounting the lower cylinder block section 6 to the main body of the cylinder block 2, a stress is allowed to be produced against the fastening force of the bolt 23 to the boss section 46 of the lower cylinder block section 6 in the direction indicated by the arrow A in FIG. 9. This stress indicated by the arrow A pulls the longitudinal rib 48 in an upward direction as indicated by the arrow B, while the transverse rib 49 is pulled towards the longitudinal rib 48 in the direction as indicated by the arrow C (in the left or right direction). In other words, both of the longitudinal rib 48 and the transverse rib 49 produce pulling force by fastening the bolts 23, thereby making the lower cylinder block section 6 into a stressed state, thereby enhancing rigidity of the rear end wall 6c of the lower cylinder block section 6 and the flange 45 for mounting the transmission. Further, rigidity for connecting the lower cylinder block section 6 to the transmission is improved by mounting the transmission to the lower cylinder block section 6 in such a stressed state. In other words, rigidity against bending of the power plant is improved by the stressed state of the lower cylinder block section 6.

It should be understood herein that the foregoing text and description be interpreted to be not limitative in any respect, but to be illustrative, and any modifications, variants and changes which do not depart from the scope of the invention should be interpreted to be encompassed within the spirit and scope of the present invention.

What is claimed is:

1. A structure of a cylinder block for an internal combustion engine having a crank chamber comprising a skirt section of a main body of a cylinder block with a cylinder bore formed therein and a lower cylinder block section coupled to a bottom end of the skirt section thereof, wherein a crank shaft is disposed in the crank chamber; comprising:

a plurality of partition walls dividing transversely an inner space of the lower cylinder block section into a plurality of sections, each of the partition walls extending transversely between a left side wall and a right side wall of the lower cylinder block section; and a plurality of bearing caps disposed for supporting the crank shaft, among which at least a portion of the plurality thereof is connected at a bottom end thereof to at least a portion of the partition walls; and among which at least a portion of the plurality thereof is connected at its side portion to a side wall of the lower cylinder block section.

2. A structure of a cylinder block as claimed in claim 1, wherein at least a portion of the plurality of the bearing caps is connected at each of the side portions thereof to the side wall of the lower cylinder block section and at each of the bottom ends thereof to the corresponding partition wall.

3. A structure of a cylinder block as claimed in claim 1, wherein:

the lower cylinder block section has at least one hole extending through at least one of the partition walls, and passes through a side wall thereof;

the hole having an opening disposed so as to face a side surface of the bearing cap and so as to allow a bolt to be inserted thereunto through a sliding bush; and the side wall of the lower cylinder block section is connected to a side portion of the bearing cap through the bolt.

4. A structure of a cylinder block as claimed in claim 1, wherein:

the lower cylinder block section has a plurality of column sections juxtaposed at the side wall thereof in a spaced arrangement with each other in a longitudinal direction, each of the column sections extending in a vertical direction, a portion interposed between the column section and the adjacent column section constituting a thin plate section, and the column section being so arranged as to project in an outward direction outside of the thin plate section thereof; and the column section has a hole extending in a vertical direction and passing over the entire length therethrough, thereby bolting the lower cylinder block section and an oil pan mounted to a bottom end of the lower cylinder block section to the main body of the cylinder block by inserting a common bolt through the hole and fastening them with the common bolt.

5. A structure of a cylinder block as claimed in claim 4, wherein:

a portion of the thin plate portions facing the crank chamber (5) for a cylinder is removed so as to form a first open section facing a side of the lower cylinder block section;

a portion of the adjacent thin plate portions facing the adjacent crank chamber (5) for a cylinder is removed so as to form a second open section facing a side of the lower cylinder block section; and the first open section is communicated to the second open section by the aid of a member for forming a path fixed to the column section and disposed at the side wall of the lower cylinder block section.

6. A structure of a cylinder block as claimed in claim 1, wherein:

each of the bearing caps for the cylinder and the adjacent cylinder among the plurality of the bearing caps, in which the respective pistons move in the same direction, is connected at its side portion to the side wall of the lower cylinder block section; and each of the bearing caps for the cylinder and the adjacent cylinder among the plurality of the cylinder caps, in which the respective pistons move in the opposite directions, is connected at its bottom end to the corresponding partition wall.

7. A structure of a cylinder block as claimed in claim 6, wherein each of the bearing caps for the cylinder and the adjacent cylinder among the plurality of the bearing caps, in which the respective pistons move in the same direction, is connected at its side portion to the side wall of the lower cylinder block section by the aid of the bolt passing transversely over the entire length through the side wall of the lower cylinder block section.

8. A structure of a cylinder block as claimed in claim 7, wherein the side portion of each of the bearing caps for the cylinder and the adjacent cylinder among the plurality of the bearing caps, in which the respective pistons move in the same direction, has a boss section projecting towards side and having a threaded hole through which the bolt is threaded.

9. A structure of a cylinder block as claimed in claim 1, wherein:

the lower cylinder block section is of such a shape as extending gradually larger and larger in an outwardly rearward direction as its outer side portion approaches its rear end and the lower cylinder block section has a flange for mounting a transmission disposed on a rear end surface of the lower cylinder block section;

the lower cylinder block section is provided at its bottom end with a seat for mounting an oil pan in a position away in a distance ahead of the rear end section of the lower cylinder block section; and the rear end section of the lower cylinder block section is provided with a rib connecting the rear end wall of the lower cylinder block section to a rear end of the seat for mounting the oil pan.

10. A structure of a cylinder block as claimed in claim 9, wherein:

one of the partition walls is located at the rear end section of the lower cylinder block section at a position away from and at a distance rearward of the rear end of the seat for mounting the oil pan;

the partition wall located at the rear end section of the lower cylinder block section and the rear end wall of the lower cylinder block section are provided with at least one hole passing vertically over the entire length through the partition wall located thereat and the rear end wall of the lower cylinder block section, and the bottom portion of the bearing cap is connected to the partition wall and the rear end wall of the lower cylinder block section through a bolt inserted through the hole;

a portion of the rear end section of the lower cylinder block section, where the hole for inserting the bolt through the partition wall and through the rear end wall of the lower cylinder block section is provided, includes a concave portion whose opening faces downwards, wherein the hole has a lengthwise dimension for inserting the bolt through the partition wall which is substantially identical to a lengthwise dimension of the hole for inserting the bolt through the rear end wall of the lower cylinder block section; and a periphery of the concave portion is defined by a rib projecting downwards.

11. A structure of a cylinder block as claimed in claim 1, wherein:

a rear end section of the lower cylinder block section is of such a shape that its outer side surface is expanded gradually larger and larger as its side portion approaches a rear end of the lower cylinder block section and the rear end section thereof is provided with a flange for mounting a transmission;

the rear end section of the lower cylinder block section has a boss section extending transversely along a rear end wall and the boss section is provided with a hole extending therethrough;

the hole has an opening facing a side surface of a bearing cap disposed at the rear end wall of the lower cylinder block section, and a bolt inserted through the hole is threaded with a threaded hole formed on a side portion of the bearing cap;

the rear end wall of the lower cylinder block section is provided with a transverse rib and a longitudinal rib;

the transverse rib is connected at its left and right ends to the flange for mounting the transmission; and the longitudinal rib is connected at its top end to the boss section and at its bottom end to the flange for mounting the transmission and is disposed so as to intersect the transverse rib.

12. A structure of a cylinder block for an internal combustion engine having a crank chamber comprising a skirt section of a main body of a cylinder block with a cylinder bore and a lower cylinder block section connected to a bottom end of the skirt section, wherein a crank shaft is disposed within the crank chamber; comprising:

a rear end section of the lower cylinder block section is of such a shape that its outer side surface is expanded gradually larger and larger as its side portion approaches a rear end of the lower cylinder block section and the rear end section thereof is provided with a flange for mounting a transmission;

the rear end section of the lower cylinder block section has a boss section extending transversely along a rear end wall and the boss section is provided with a hole extending therethrough;

the hole has an opening facing a side surface of a bearing cap to be disposed at the rear end wall of the lower cylinder block section, and a bolt inserted through the hole is threaded with a threaded hole formed on a side portion of the bearing cap;

the rear end wall of the lower cylinder block section is provided with a transverse rib and a longitudinal rib;

the transverse rib is connected at its left and right ends to the flange for mounting the transmission; and the longitudinal rib is connected at its top end to the boss section and at its bottom end to the flange for mounting the transmission and is disposed so as to intersect the transverse rib.

* * * * *